US008713856B1

(12) United States Patent
Bellissimo et al.

(10) Patent No.: US 8,713,856 B1
(45) Date of Patent: May 6, 2014

(54) FOLDING SWIVEL SEAT AND TABLE

(75) Inventors: Joseph Bellissimo, Winson-Salem, NC (US); Billy Dean Prim, Winston-Salem, NC (US); Gerald Leroy Mayse, Kettering, OH (US)

(73) Assignee: 4Topps, LLC, Winston-Salem, NC (US)

( * ) Notice: Subject to any disclaimer, the term of this patent is extended or adjusted under 35 U.S.C. 154(b) by 263 days.

(21) Appl. No.: 13/163,842

(22) Filed: Jun. 20, 2011

Related U.S. Application Data

(60) Provisional application No. 61/356,128, filed on Jun. 18, 2010.

(51) Int. Cl.
*E04H 3/12* (2006.01)
*E04H 3/22* (2006.01)

(52) U.S. Cl.
CPC ... *E04H 3/12* (2013.01); *E04H 3/22* (2013.01)
USPC ..... 52/8

(58) Field of Classification Search
USPC ..... 52/8, 9, 10, 6, 36.1, 234, 29, 36.4, 52/169.2, 174, 238.1, 239, 33; 472/92; 182/223; 434/72, 80; 108/59, 64, 102, 108/137, 143
See application file for complete search history.

(56) References Cited

U.S. PATENT DOCUMENTS

| | | | | |
|---|---|---|---|---|
| 276,830 | A | | 5/1883 | Knight |
| 709,286 | A | | 9/1902 | Wilkinson |
| 775,879 | A | | 11/1904 | Wiersching et al. |
| 941,983 | A | | 11/1909 | Elsner |
| 1,007,041 | A | | 10/1911 | Miller |
| 1,015,799 | A | | 1/1912 | Hazen |
| 1,318,439 | A | | 10/1919 | Erickson |
| 3,477,760 | A | * | 11/1969 | Bue et al. ..... 297/158.3 |
| 4,557,080 | A | | 12/1985 | Walworth et al. |
| 4,861,108 | A | | 8/1989 | Acton et al. |
| 4,889,385 | A | | 12/1989 | Chadwick et al. |
| 5,083,838 | A | * | 1/1992 | Maxwell, Jr. ..... 297/244 |
| 5,201,567 | A | | 4/1993 | Beasley |
| 5,328,231 | A | | 7/1994 | Raymond |
| 5,915,783 | A | | 6/1999 | McDowell et al. |
| 5,947,417 | A | * | 9/1999 | Cameron ..... 244/129.5 |
| 5,957,529 | A | * | 9/1999 | Schrewe ..... 297/232 |
| 6,106,060 | A | | 8/2000 | Staehlin |
| 6,254,185 | B1 | * | 7/2001 | Staehlin et al. ..... 297/257 |
| 6,375,256 | B1 | * | 4/2002 | Rais ..... 297/157.1 |
| 6,755,474 | B2 | | 6/2004 | Magnuson |
| 6,922,949 | B2 | * | 8/2005 | Cornell et al. ..... 52/36.1 |
| 8,407,944 | B2 | * | 4/2013 | Baloga et al. ..... 52/36.1 |
| 2003/0022614 | A1 | * | 1/2003 | Momemy ..... 453/17 |
| 2006/0117669 | A1 | * | 6/2006 | Baloga et al. ..... 52/8 |
| 2006/0131809 | A1 | * | 6/2006 | Lancaster et al. ..... 273/292 |
| 2008/0143818 | A1 | * | 6/2008 | Ferren et al. ..... 348/14.08 |
| 2008/0190038 | A1 | * | 8/2008 | Jacobs et al. ..... 52/9 |
| 2008/0217979 | A1 | * | 9/2008 | King ..... 297/338 |
| 2010/0210350 | A9 | * | 8/2010 | Walker et al. ..... 463/25 |
| 2010/0216100 | A1 | * | 8/2010 | Bobryshev et al. ..... 434/157 |

* cited by examiner

*Primary Examiner* — William Gilbert
*Assistant Examiner* — Kyle Walraed-Sullivan
(74) *Attorney, Agent, or Firm* — Joseph T. Guy; Perkins Law Firm LLC

(57) ABSTRACT

A seating system with a platform and a semicircular table mounted on the platform. Four folding swivel seats are mounted and arranged in an arcuate arrangement around the semicircular table wherein each folding swivel seat has a seat portion, a back and a center of the seat portion. Each folding swivel seat is a seat distance wherein the seat distance is at least 8 inches to no more than 24 inches. Adjacent folding swivel seats are separated by a distance from the center of adjacent folding swivel seats. Two folding swivel seats are separated from a projection of a table flat portion.

16 Claims, 8 Drawing Sheets

FOLDING SWIVEL SEAT AND TABLE

CROSS-REFERENCE TO RELATED APPLICATIONS

The present application claims priority to pending U.S. Provisional Appl. No. 61/356,128 filed Jun. 18, 2010 which is incorporated herein by reference.

BACKGROUND

The present invention is related to an improvement in seating, particularly stadium seating, comprising an arrangement of a table and a plurality of folding swivel seats.

Seating space in an arena or sporting venue is of utmost importance. Revenue is often directly related to the number of seats sold for an event and it is therefore an ongoing desire to maximize the number of seats available for sale. A conflicting reality is the requirement that each fan must be provided with an environment which is conducive to interacting with their peers, a good view of the event and, generally, an environment suitable for an enjoyable event.

Arena or stadium seating is typically approximately linearly arranged with seats generally side-by-side and rows separated by the narrowest margin possible. With linearly arranged seating interactions occur, primarily, with the person to either side since interactions beyond that are awkward at best. With groups of four, for example, the people on each end are next to someone they may not even know and they are unable to communicate effectively with those that they attended the event with. A linear arrangement provides the highest practical seating density yet it is severely lacking with regards to fan comfort. For example, most fans enjoy some form of beverage or food at an event yet there is no convenient place to set beverage containers or food containers. Holders in the arm rest widen the overall footprint of a seat or limit the separation between rows neither of which is acceptable. Holders on the back of the seats, for use by the person to the rear, protrude slightly into the walkway between the rows and therefore are a hindrance to passage. Seated participants must stand to allow someone to pass through the aisle and any protrusion from a beverage holder further exasperates the constriction.

Yet another problem is the unused areas around an arena or sporting venue. Most venues are multiuse facilities with a variety of arrangements. A baseball game, for example, will have a different arrangement than a musical concert or a football game. Therefore, it is a necessity to have a modular arrangement since this allows the arena to be oriented in a variety of arrangements to maximize revenue. There is a desire to utilize mezzanine areas, staircase areas and the like in some circumstances yet systems for doing so are lacking in the art.

There continues to be a desire for a seating arrangement which is flexible, comfortable to the user, which provides an enhanced ability to interact with more than the immediate neighbor, and which provides a convenient location for beverages and food.

SUMMARY

It is an object of the invention to provide an improved seating system primarily for use in arena or sporting venues.

It is another object of the invention to provide a seating system which allows users to interact effectively beyond their nearest neighbor and preferably within a chosen group.

A particular feature of the invention is the convenience factor associated with users being able to enter, and depart, without disrupting others.

These and other advantages, as will be realized, are provided in a seating system. The seating system has a platform and a semicircular table mounted on the platform. Four folding swivel seats are mounted on the platform and arranged in an arcuate arrangement around the semicircular table wherein each folding swivel seat has a seat portion, a back and a center of the seat portion. Each folding swivel seat is a seat distance, measured as a length of a line segment wherein the line segment is perpendicular to a tangent of the semicircular table and the line segment extends from the tangent to the center, wherein the seat distance is at least 8 inches to no more than 24 inches. Adjacent folding swivel seats are separated by a distance of at least 20 inches to no more than 35 inches as measured from the center of adjacent folding swivel seats. Two folding swivel seats are separated from a projection of a table flat portion by at least 15 inches to no more than 35 inches as measured from the center to the projection and perpendicular to the projection.

Yet another embodiment is provided in a modular stadium. The modular stadium has at least one platform with a semicircular table mounted on the platform. Four folding swivel seats are mounted on the platform and arranged in an arcuate arrangement around the semicircular table wherein each folding swivel seat has a seat portion and a back and a center of the seat portion. Each folding swivel seat is a seat distance measured as a length of a line segment wherein the line segment is perpendicular to a tangent of the semicircular table and extends between the tangent and the center wherein the seat distance is at least 8 inches to no more than 24 inches. Adjacent folding swivel seats are separated by a distance of at least 20 inches to no more than 35 inches as measured from the center of the adjacent folding swivel seats. Two folding swivel seats are separated from a projection of a table flat portion by at least 15 inches to no more than 35 inches as measured from the center to the projection.

DETAILED DESCRIPTION

The present invention is specific to an improved folding swivel seat and table arrangement which is particularly suitable for use in arena and sporting venue applications. More specifically, the present invention is specific to a particular arrangement of folding swivel seat and table arrangements which are arcuately arranged for convenient access into and out of the seating space.

The invention will be described with reference to the figures which form an integral, non-limiting, portion of the invention. In the various figures, similar elements will be numbered accordingly.

Figure 1:
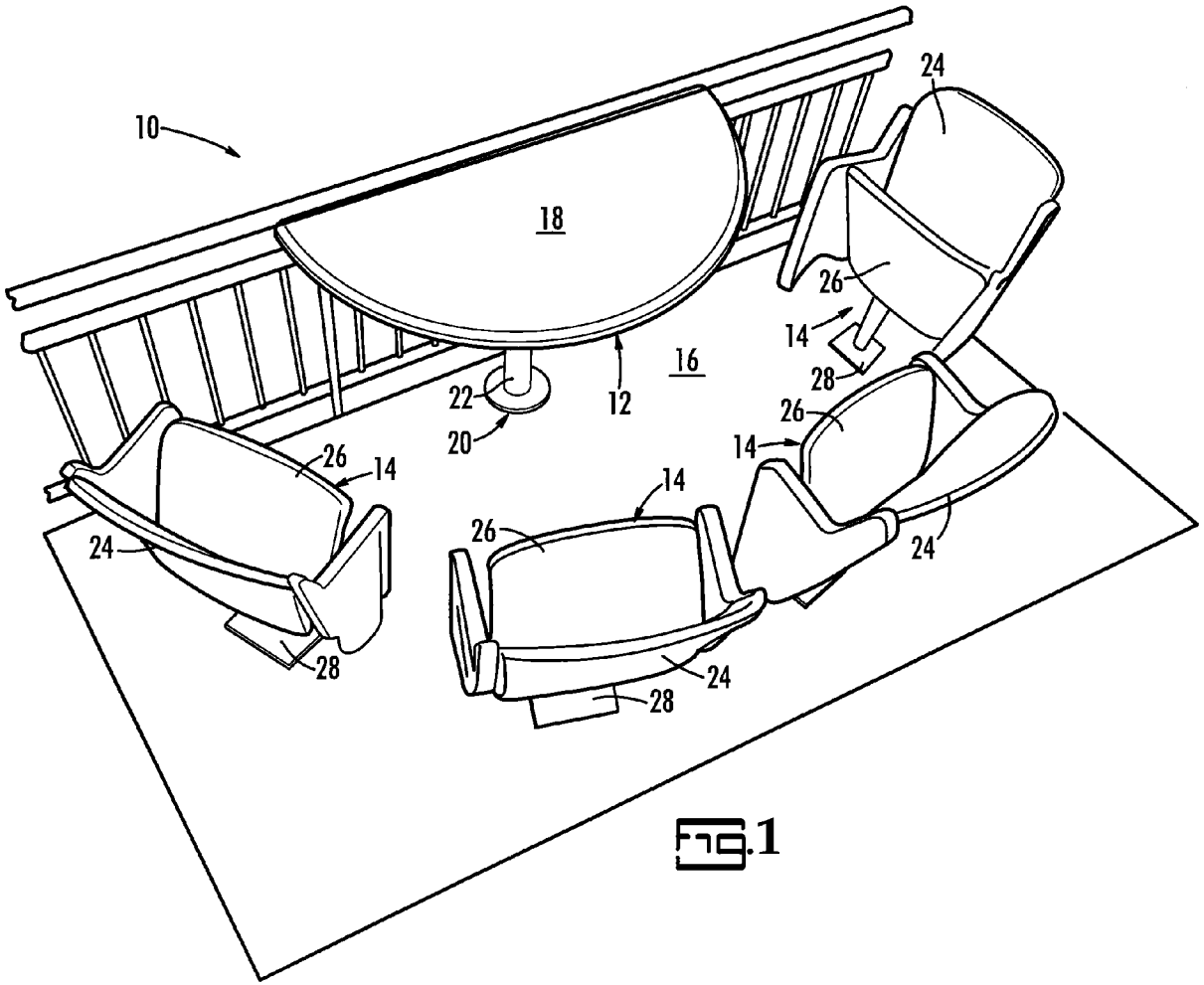
FIG. 1 is a perspective view of an embodiment of the invention.

An embodiment of the invention is illustrated in schematic perspective view in FIG. 1. In FIG. 1, the folding swivel seat and table system, 10, comprises a semicircular table, 12, and four folding swivel seats, 14, each independently mounted on a surface, 16. the surface has a planar area sufficiently large for placement of the table and folding swivel seats as well as room for egress and ingress between the folding swivel seats as will be realized. The surface can be integral to a modular stadium or a movable platform which can be placed on an integral surface of a stadium. An integral surface is typically, but not limited to, concrete or steel. The integral surface can be planer or can contain risers and treads to form steps.

The semicircular table, 12, comprises a semicircular table top, 18, which is preferably a half-circle, and a pedestal, 20, mounted to the underside of the semicircular table top. A mounting flange, 22, on the bottom of the pedestal allows the table to be secured to the surface, 16. The pedestal is preferably closer to the flat portion of the semicircle and most preferably and the downward projection of the flat portion of the semicircular contains the pedestal. It is most preferable that the furthest extent of the pedestal is no more than 6 inches from the flat portion of the table.

Each folding swivel seat, 14, comprises a back, 24, and a seat portion, 26. The seat portion folds towards the back towards parallel thereby increasing the closest distance between the semicircular table and folding swivel seat as will be more fully explained below. The folding swivel seats have a flange, 28, on the bottom thereby allowing the folding swivel seats to be mounted to the surface, 16.

Figure 2:
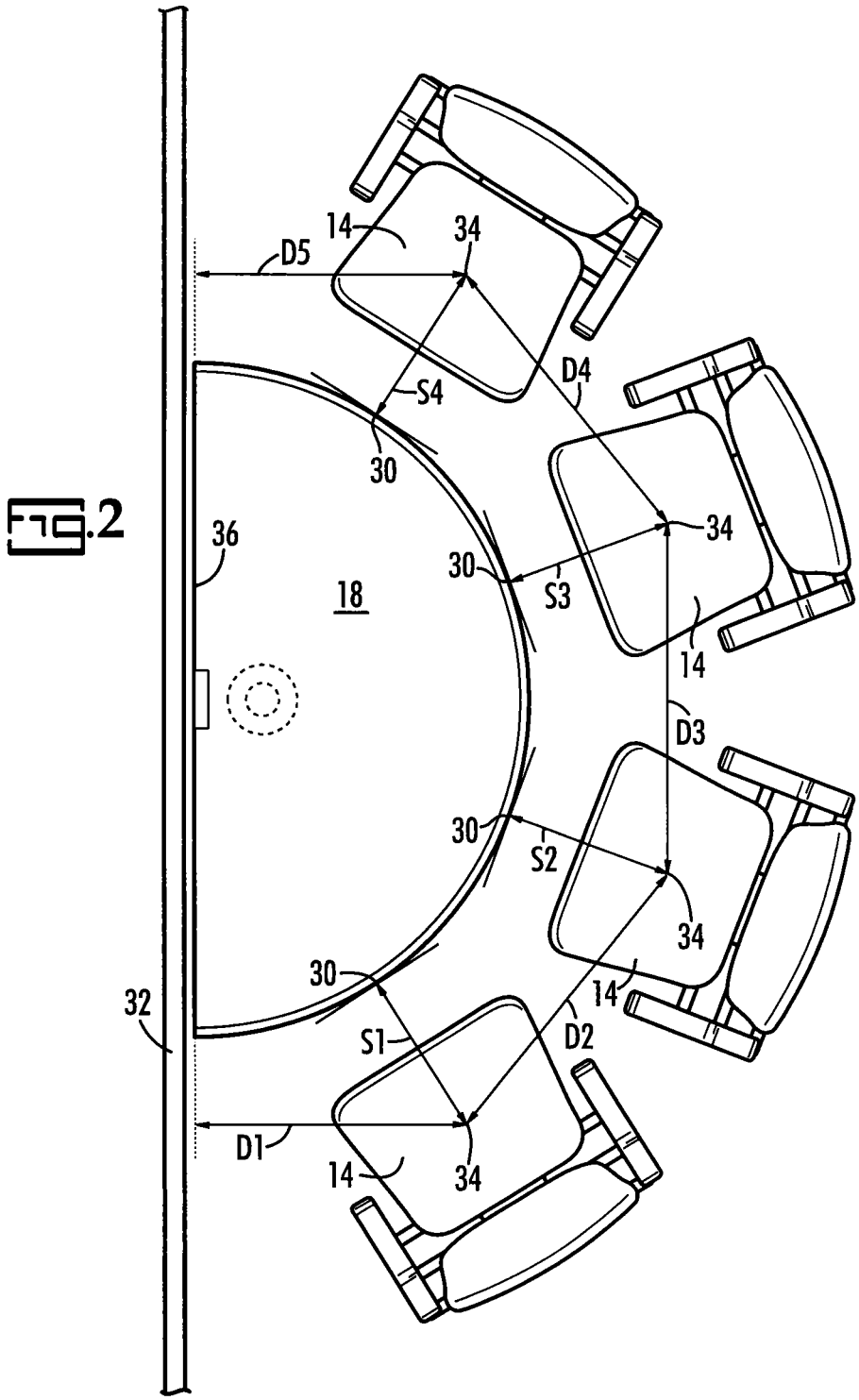
FIG. 2 is a top view of an embodiment of the invention.

The arrangement of the folding swivel seats and table are illustrated in FIG. 2. In FIG. 2, the semi-circular table, 18, is shown with the flat portion of the semicircle in close proximity to a rail, 32. It is most preferable that the flat portion be from zero to no more than 12 inches from the rail to maximize the use of space. The center of each seat portion, 34, defined as the geometrical center of the seat portion, is a seat distance, S1-S4, from the table measured as the length of a line segment extending from a perpendicular to the tangent, 30, of the table at the table to the center of the seat portion. The seat distance is preferably the same for each folding swivel seat and is preferably at least 8 inches to no more than 24 inches. More preferably, the seat distance is at least 10 inches to no more than 22 inches. Most preferably, the seat distance is at least 16 inches to no more than 20 inches. The distances between each center of the seat portion, D2-D4, is also the same and is preferably at least 20 inches to no more than 35 inches. More preferably, the seat distance is at least 22 inches to no more than 32 inches with 26 inches to 30 inches being most preferred. The distance between the terminal folding swivel seats and the projection of the table flat portion, 36, measured perpendicular to the projection, represented as D1 and D5, is preferably at least 15 inches to no more than 35 inches. More preferably, the seat distance is at least 17 inches to no more than 32 inches and even more preferably at least 19 inches to no more than 23 inches. A particular advantage of the arrangement is that each seated person can communicate with each of the other three seated people with a direct line of sight. This improves communication to those other than the person seated immediately to the side. The table is a convenient distance for use with beverages, food and other items of interest.

Figure 3:
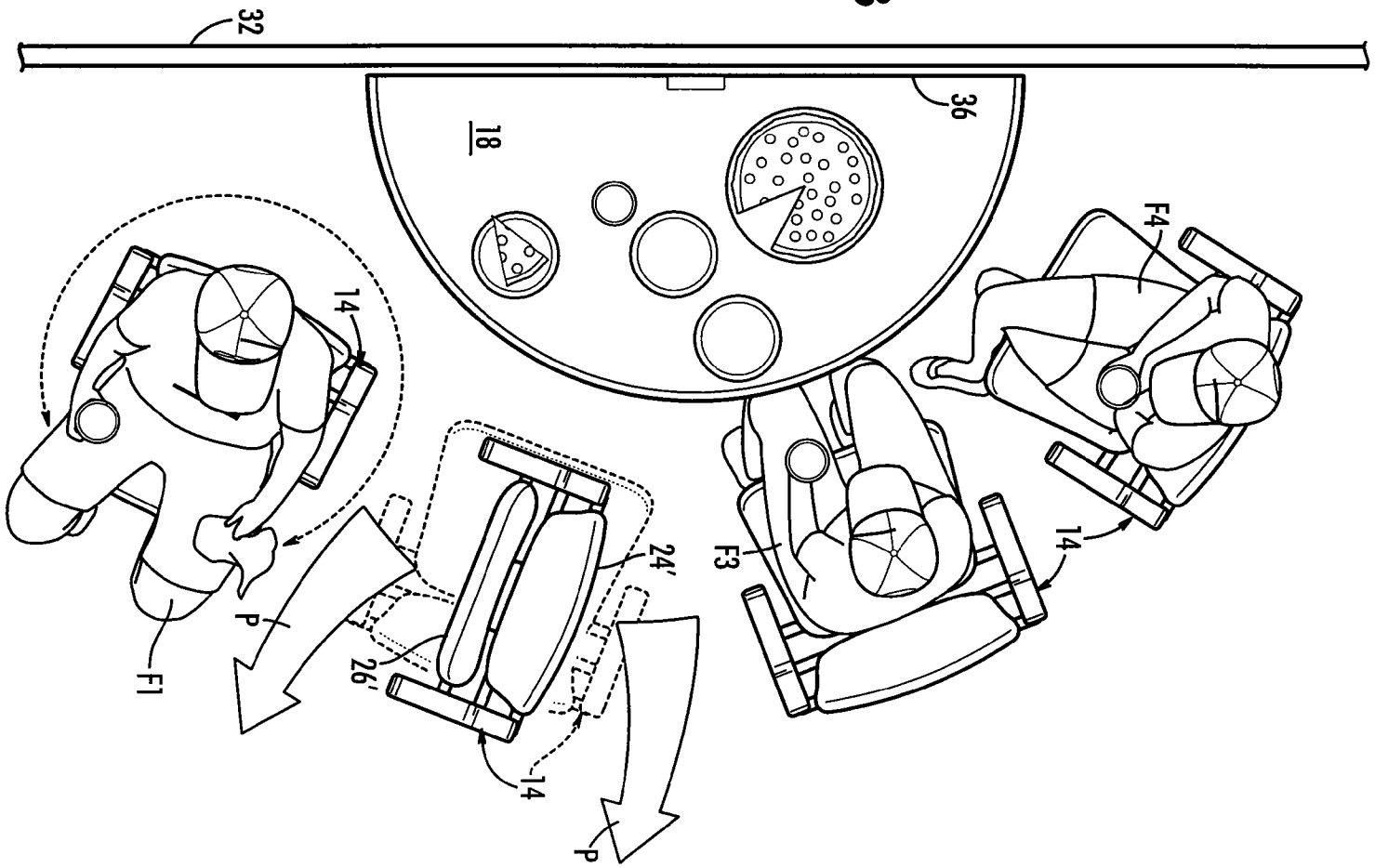
FIG. 3 is a top view of an embodiment of the invention.

An advantage of the invention will be described with reference to FIG. 3. In FIG. 3, three folding swivel seats are occupied. Each seat can rotate 360° thereby allowing viewing to the rear as indicted by fan, F1. Alternatively, the terminal fan, F1, can rotate to have a direct line of sight to central fan, F3, and the other terminal fan, F4, in a normal seated position or the seat can be rotated to have a direct view of the event which is typically approximately perpendicular to the rail, 32. This visibility of the event and non-adjacent fans is not feasible with seats arranged in a linear fashion. Yet another advantage is realized by the unoccupied folding swivel seat, 14'. By folding the seat portion, 26', towards parallel with the back, 24', and rotating the seat a passage way, P, is created between the unoccupied folding swivel seat and the occupied folding swivel seat on either side thereof. One of skill in the art would appreciate that the terminal fans, F1 and F4 could exit between the rail and their folded swiveled seat or between their folded swiveled seat and the adjacent seat whether occupied or not. This allows each fan to enter and exit the seat without disrupting the person to either side.

Figure 4:
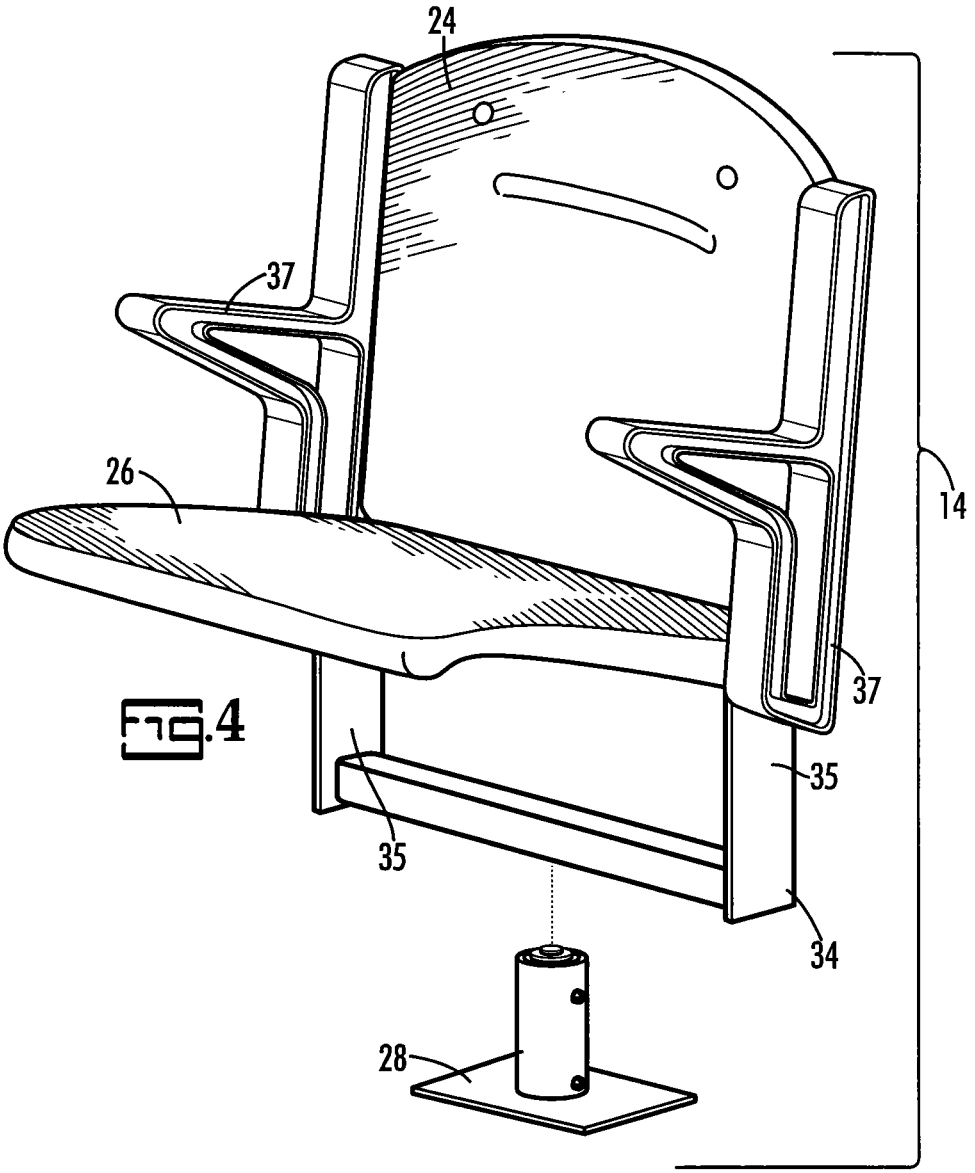
FIG. 4 is an exploded view of an embodiment of the invention.

A folding swivel seat is illustrated in schematic exploded view in FIG. 4. In FIG. 4, the seat, 14, comprises a seat portion, 26, and a back, 24. As discussed above the seat portion folds towards parallel with the back. The flange, 28, allows the folding swivel seat to be mounted to a surface. A pedestal, 32, attached to a frame element, 34, allows rotation about the axis of the pedestal. The frame element comprises uprights, 35, which are attached to the arm elements, 37.

Figure 5:
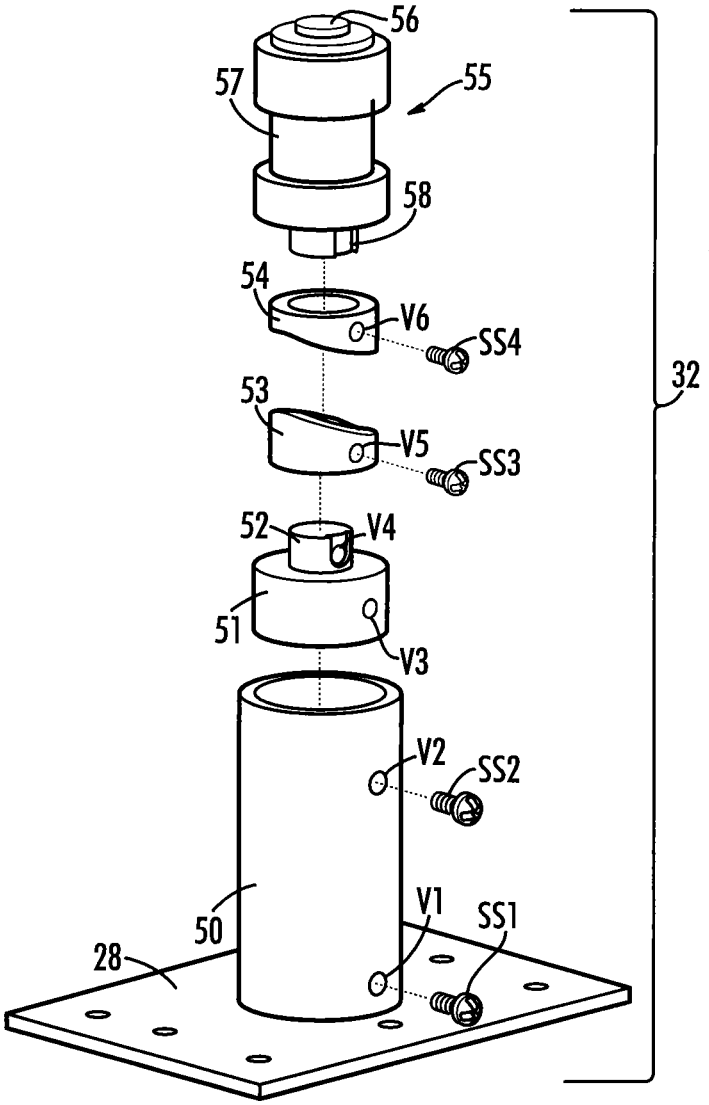
FIG. 5 is an exploded view of an embodiment of the invention.

An embodiment of a pedestal is illustrated in exploded view in FIG. 5. In FIG. 5, a mounting tube, 50, is attached to a flange, 28. A base component, 51, is received in the mounting tube and secured from rotation relative to the mounting tube by a set screw, SS1, inserted in aligned voids, V1 and V3. The base component, 51, comprises a neck, 52, which is received in a first inclined collar, 53. The inclined collar is secured by set screw, SS3, which extends into aligned voids V4 and V5. An upper component, 55, comprising a groove, 57, and a neck, 58, is interior to the mounting tube, 32. A second inclined collar, 54, receives the neck, 58, of the upper component and is rotationally fixed to the neck by a set screw, SS4, which extends into void V6 and engages with a slot in neck, 58. A set screw, SS2, extends through void V2 and into groove, 57, thereby allowing the upper component to rotate and rise or lower upon rotation due to the mating inclines rotation relative to each other. The seat is mounted to a nipple, 56, on the upper component. The first inclined collar and second inclined collar rotate in relative opposite direction upon rotation of the upper component relative to the lower component. The rotation causes a rise of the upper component, and any element attached thereto, relative to the flange. The opposing inclined collars persuade the rotation back to a position wherein the height of the upper component is at its lowest point. The pedestal allows a chair to be rotated yet it will return to a predetermined position due to gravity when the rotating force is removed. This embodiment precludes the necessity of a spring even though a spring could be incorporated if desired.

Figure 6:
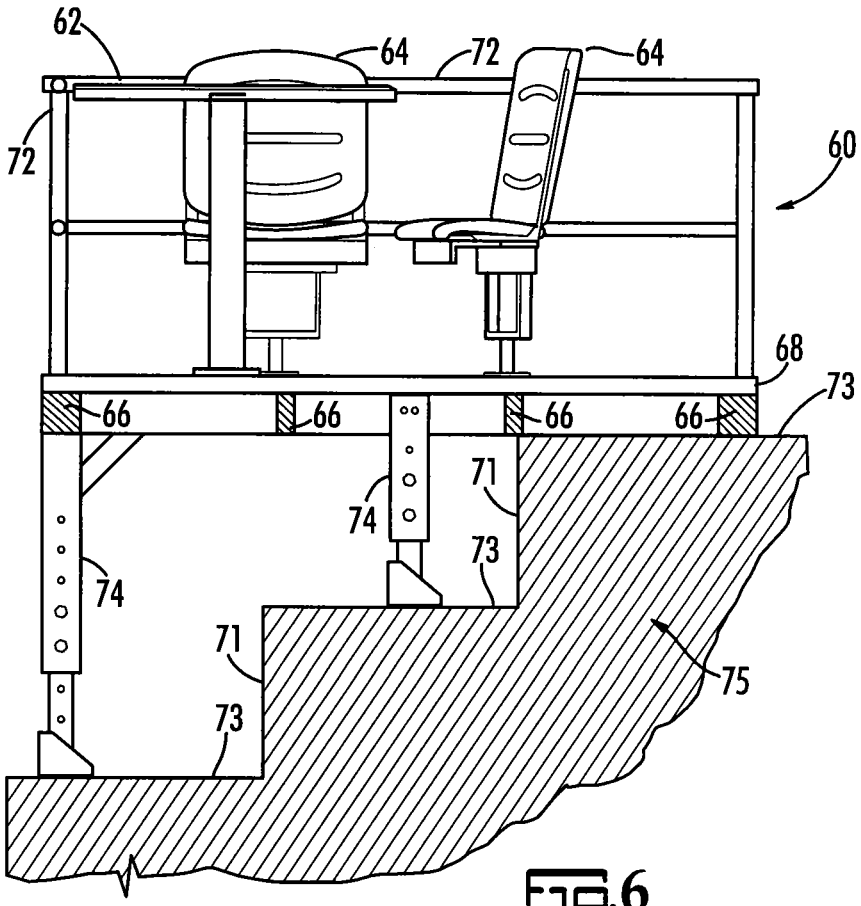
FIG. 6 is a cross-sectional side view of an embodiment of the invention.

An embodiment of the invention is illustrated in cross-sectional schematic view in FIG. 6 as a modular moveable platform, 60, particularly for use on stairs, 75, comprising risers, 71, and treads, 73. In FIG. 6, a platform, 68, has a semicircular, and preferably half circle, table, 62, and folding swivel seats, 64, mounted thereon. Optional cross-braces, 66, are provided to strengthen the platform. Rails, 72, are preferable provided on three sides of the platform. At least one, and preferably a multiplicity of, legs, 74, preferably adjustable legs, are provided to allow the modular platform to rest on an upper tread while being maintained in a level position due to a leg resting on a lower tread. It is preferable to have at least two adjustable legs with one on each elevated corner. Additional legs, which are preferably adjustable, between the platform and intermediate treads is preferred for stability. A particular advantage is the ability to rapidly, and reversibly, convert fixed bleacher type seats to premium seating. This allows seats which are typically lower priced seats, such as general admission seating, to be reversibly converted to premium seats thereby generating higher revenue for special events.

Figure 7:
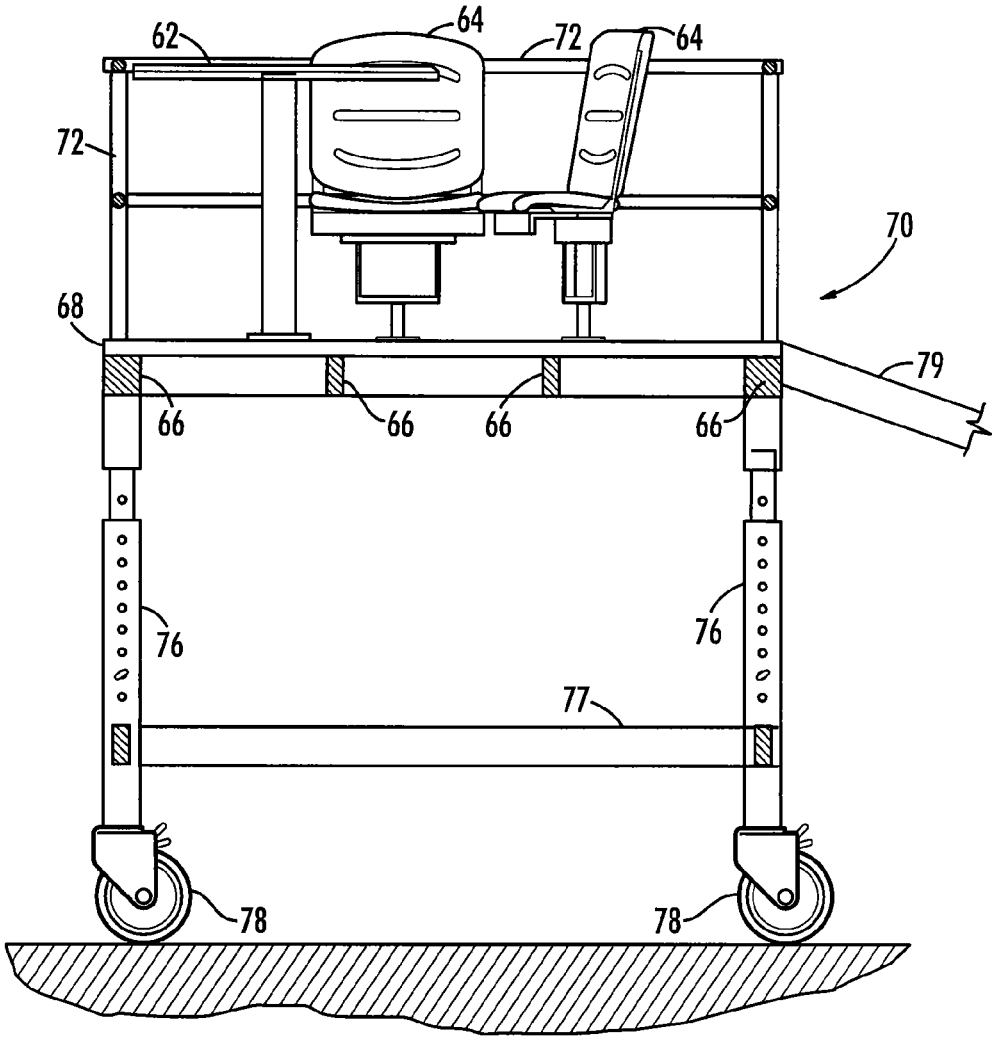
FIG. 7 is a cross-sectional side view of an embodiment of the invention.

An embodiment of the invention is illustrated in FIG. 7. In FIG. 7, an elevated modular platform, 70, is illustrated in side cross-sectional view. In FIG. 7, the platform, 68, is illustrated with optional cross-braces, 66. Adjustable legs, 76, allow the platform to be raised or lowered as desired. Wheels, 78, preferably locking caster wheels, allow the modular platform to be relocated as desired. A ramp, 79, is preferred for access to the platform. Cross-braces, 77, are preferred for stability.

Figure 8:
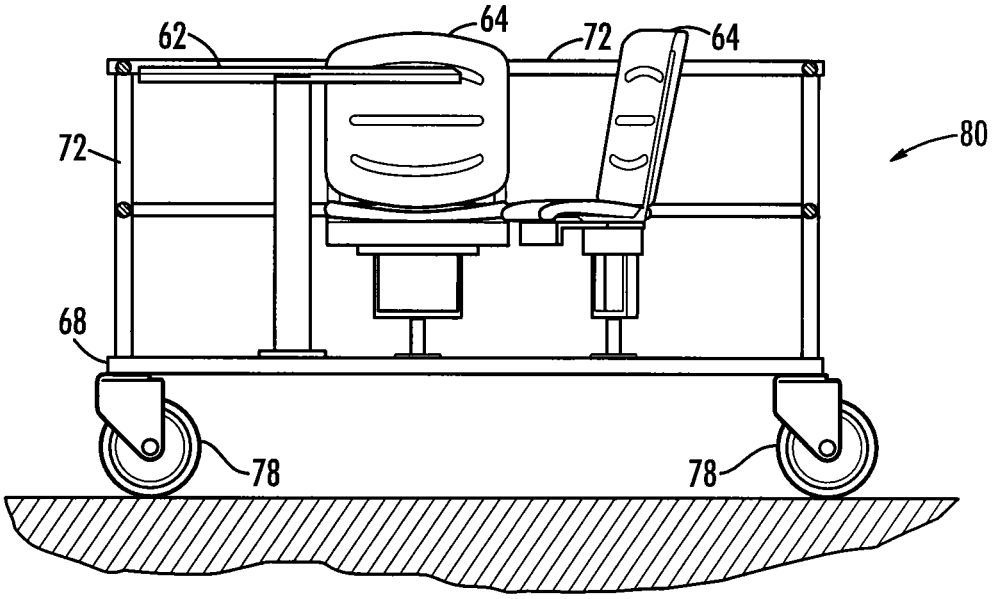
FIG. 8 is a cross-sectional side view of an embodiment of the invention.

An embodiment of the invention is illustrated in FIG. 8. In FIG. 8, a modular platform, 80, is illustrated in side cross-sectional view. In FIG. 8, the wheels, 78, which are preferably locking caster wheels, allow the modular platform to be relocated as desired.

The mechanism for folding is not particularly limited herein. In one embodiment the seat is allowed to rock backward and forward within a predetermined range and preferably the rocking motion is dampened by a spring mechanism.

The material of construction for the seat portion and back are not particularly limited herein. The seat material is any material known in the art with polymeric materials representing a preferred embodiment due to the wide spread aesthetic acceptance and cost. Other materials, such a wood based products are suitable as are mesh materials as incorporated into a sling arrangement.

The rotation of the chairs preferably includes a mechanism which returns the chair to a forward facing position when not acted on be a force. The return mechanism can be spring assisted if desired.

The seat folding mechanism may include a spring which maintains the seat in a folded position when not acted on by a force. A cantilever mechanism may be employed to return the seat to a folded position.

Semicircular includes shapes which are round or which approximate a round object such as oblong, hexagonal and the like.

Wheels are preferably locking caster wheels due to their widespread availability and their ability to easily transport heavy objects.

Throughout the specification ranges of integers, such as at least 10 inches to no more than 19 inches includes all intermediate integers such as 11, 12, 13, 14, 15, 16, 17 and 18.

The invention has been described with specific reference to the preferred embodiments without limit thereto. One of skill in the art would realize additional embodiments and alterations which are within the scope of the invention but not specifically enumerated.

Claimed is:

1. A modular stadium comprising:

at least one platform;

a semicircular table mounted on said platform;

four folding swivel seats mounted on said platform and arranged in an arcuate arrangement around said semicircular table wherein said each folding swivel seat of said folding swivel seats comprises a seat portion and a back and a center of said seat portion;

wherein each folding swivel seat has a seat distance measured as a length of a line segment wherein said line segment is perpendicular to a tangent of said semicircular table and extends between said tangent and said center wherein said seat distance is at least 8 inches to no more than 24 inches;

an unobstructed passageway between adjacent seats that a person may pass through;

wherein adjacent folding swivel seats of said four folding seats are separated by a distance of at least 20 inches to no more than 35 inches as measured from said center of said adjacent folding swivel seats; and wherein two folding swivel seats of said four folding seats are separated from a projection of a table flat portion by at least 15 inches to no more than 35 inches as measured from said center to said projection.

2. The modular stadium of claim 1 wherein said stadium comprises risers and treads.

3. The modular stadium of claim 2 further comprises at least one leg attached to said platform opposite said semicircular table.

4. The modular stadium of claim 3 wherein said leg is adjustable.

5. The modular stadium of claim 3 comprising multiple adjustable legs.

6. The modular stadium of claim 3 wherein said platform is on a first riser and at least one leg is on a second riser.

7. The modular stadium of claim 1 wherein said platform is integral to said modular stadium.

8. The modular stadium of claim 1 wherein said platform is a movable platform.

9. The modular stadium of claim 1 wherein said seat distance is at least 10 inches to no more than 22 inches.

10. The modular stadium of claim 9 wherein said seat distance is at least 16 inches to no more than 20 inches.

11. The modular stadium of claim 1 wherein said seat portion folds towards a parallel relationship with said back.

12. The modular stadium of claim 1 wherein at least one said swivel folding seat comprises a pedestal.

13. The modular stadium of claim 12 wherein said pedestal comprises opposing inclined collars.

14. The modular stadium of claim 1 further comprising at least one wheel below said platform.

15. The modular stadium of claim 14 wherein at least one said wheel is attached to said platform.

16. The modular stadium of claim 1 wherein said semicircular table is a half-circle.

* * * * *